US008890646B2

(12) United States Patent
Noguchi et al.

(10) Patent No.: US 8,890,646 B2
(45) Date of Patent: Nov. 18, 2014

(54) LAMINATED-TYPE ELECTRONIC COMPONENT

(71) Applicant: Toko, Inc., Tsurugashima (JP)

(72) Inventors: Yutaka Noguchi, Tsurugashima (JP); Makoto Yamamoto, Tsurugashima (JP); Satoru Maeda, Tsurugashima (JP)

(73) Assignee: Toko, Inc., Tsurugashima-Shi, Saitama-Ken (JP)

( * ) Notice: Subject to any disclaimer, the term of this patent is extended or adjusted under 35 U.S.C. 154(b) by 5 days.

(21) Appl. No.: 13/861,507

(22) Filed: Apr. 12, 2013

(65) Prior Publication Data

US 2013/0271254 A1 Oct. 17, 2013

(30) Foreign Application Priority Data

Apr. 13, 2012 (JP) ..... 2012-091657
Nov. 30, 2012 (JP) ..... 2012-262071

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 3/14*** | (2006.01) |

(52) U.S. Cl.

CPC ..... *H01F 17/0013* (2013.01); *H01F 3/14* (2013.01); *H01F 17/0033* (2013.01)

USPC ..... 336/200; 336/232

(58) Field of Classification Search

USPC ..... 336/200, 232

See application file for complete search history.

(56) References Cited

U.S. PATENT DOCUMENTS

| | | | | |
|---|---|---|---|---|
| 6,515,568 | B1 * | 2/2003 | Maki et al. | 336/200 |
| 6,914,513 | B1 * | 7/2005 | Wahlers et al. | 336/233 |
| 7,527,744 | B2 * | 5/2009 | Wada et al. | 252/62.6 |
| 2006/0006972 | A1 * | 1/2006 | Tozawa et al. | 336/200 |

FOREIGN PATENT DOCUMENTS

| | | |
|---|---|---|
| JP | 2-165607 | 6/1990 |

* cited by examiner

*Primary Examiner* — Tsz Chan

(74) *Attorney, Agent, or Firm* — Renner, Kenner, Greive, Bobak, Taylor & Weber

(57) ABSTRACT

A laminated-type electronic component including: plural magnetic material layers; plural conductive patterns; a laminated layer body formed by laminating the plural magnetic material layers and the plural conductive patterns; a coil formed in the laminated layer body by connecting the conductive patterns between the magnetic material layers; and at least one magnetic gap formed in the laminated layer body, wherein the magnetic gaps are formed of a compound of Ni and Cu.

4 Claims, 5 Drawing Sheets

| Specimen No. | Magnetic Material Layer | | | | | Magnetic Gap | | Variation in L Value (%) | |
|---|---|---|---|---|---|---|---|---|---|
| | mol% | | | | wt% | Ni : Cu | | | |
| | ZnO | CuO | NiO | $Fe_2O_3$ | $SnO_2$ | Ni | Cu | -55℃ | 150℃ |
| 1 | 1 | 6 | 45 | 48 | 0.6 | 8 | 2 | 0.25 | 0.01 |
| *2 | 1 | 6 | 45 | 48 | 0.6 | Cu-Zn Ferrite | | 1.61 | -0.48 |
| *3 | 25 | 9 | 19 | 47 | 1 | 0 | 10 | - | - |
| *4 | 25 | 9 | 19 | 47 | 1 | 1 | 9 | - | - |
| 5 | 25 | 9 | 19 | 47 | 1 | 2 | 8 | -1.33 | 1.26 |
| 6 | 25 | 9 | 19 | 47 | 1 | 5 | 5 | -1.20 | 1.51 |
| 7 | 25 | 9 | 19 | 47 | 1 | 8 | 2 | -1.01 | 1.33 |
| *8 | 25 | 9 | 19 | 47 | 1 | 9 | 1 | - | - |
| *9 | 25 | 9 | 19 | 47 | 1 | 10 | 0 | - | - |
| *10 | 25 | 9 | 19 | 47 | 1 | Cu-Zn Ferrite | | 2.78 | -4.50 |
| 11 | 14 | 10 | 27 | 49 | 1.5 | 8 | 2 | -0.18 | 1.47 |
| *12 | 14 | 10 | 27 | 49 | 1.5 | Cu-Zn Ferrite | | 4.45 | -7.41 |
| *13 | 14 | 10 | 27 | 49 | 1.5 | - | - | -0.38 | 1.49 |
| *14 | 14 | 10 | 27 | 49 | 0 | - | - | -6.35 | 8.64 |

FIG. 5

LAMINATED-TYPE ELECTRONIC COMPONENT

CROSS REFERENCE TO RELATED APPLICATIONS

This application is based upon and claims the benefit of priority from the prior Japanese Patent Applications No. 2012-91657 filed on Apr. 13, 2012 and No. 2012-262071 filed on Nov. 30, 2012, the entire contents of which are incorporated herein by reference.

BACKGROUND OF THE INVENTION

1. Field of the Invention

The present invention relates to a laminated-type electronic component in which magnetic material layers and conductive patterns are laminated, the conductive patterns disposed between the magnetic material layers are connected to form a coil in a laminated layer body, and at least one magnetic gap is also formed in this laminated layer body.

2. Related Art

One of conventional laminated-type electronic components is configured to laminate magnetic material layers and conductive patterns, and spirally connect the conductive patterns disposed between the magnetic material layers to form a coil in its laminated layer body.

Recently, laminated-type electronic components of this type have been increasingly used in power supply circuits where large currents flow and in inductors or transformers for DC-DC converter circuits, and others. The laminated-type electronic components of this type are desired to be small-sized, and have a large DC superimposed allowable current value. In order to increase the DC superimposed allowable current value, such a solution has been used that increases line widths of the conductive patterns so as to reduce a DC resistance of the coil, or that laminates magnetic material layers and conductive patterns 61A to 61E to form a laminated layer body, and also forms magnetic gaps 62 in the laminated layer body so as to prevent magnetic saturation of the magnetic material used in the laminated layer body, as shown in FIG. 6, (see Japanese Patent Laid-Open No. 02-165607).

In such a conventional laminated-type electronic component having magnetic material layers of Ni-based ferrite, Zn-based or Cu—Zn-based ferrite is used in the magnetic gaps for the purpose of securing preferable junctions between the magnetic material layers and the magnetic gaps. In this laminated-type electronic component, elements of the magnetic material layers and elements of the magnetic gaps are dispersed mutually during burning the laminated layer body, and ferrite layers having compositions graded toward opposite elements are formed at the junctions between the magnetic material layers and the magnetic gaps. Such ferrite layers cause a problem of ununiform compositions and unstable magnetic characteristics. Particularly, Ni ferrite is dispersed from the magnetic material layers toward the magnetic gaps, which forms a composition of mixture of Zn ferrite with slight amount of Ni ferrite. It has been known that such a composition has the Curie point in vicinity of a room temperature (25° C.), and if the temperature increases greater than the room temperature, its magnetic property is rapidly lost.

Hence, in the conventional laminated-type electronic component, its magnetic property is lost at the interfaces between the magnetic material layers and the magnetic gaps if the temperature is equal to or more than the Curie point. Consequently, the laminated-type electronic component has a negative temperature property, which causes a problem such as deterioration of the temperature characteristics of the coil.

In such a situation, laminated-type electronic components for use in power supply circuits or DC/DC converter circuits are disposed in a usage environment having a high temperature, and their coils generate heat due to large currents flowing in the coils, so that the laminated-type electronic components have great variation in temperature during operating. Consequently, in the conventional laminated-type electronic components, increase in temperature may cause an abrupt decrease in the inductance value.

In order to solve such a problem, it has been considered that the magnetic gaps are formed by using a mixed material of $SiO_2$ and oxide. This solution, however, has a problem that $SiO_2$ used in the magnetic gaps is dispersed in the magnetic material layers, which causes deterioration of magnetic permeability of ferrite included in the magnetic material layers.

It may be considered to use such a solution that cancels the negative temperature characteristics with positive temperature characteristics of the ferrite in the magnetic material layers. Unfortunately, this solution also has a problem that a variation range of the inductance value depends on an area of the interfaces between the magnetic material layers and the magnetic gaps, so that flexibility of structural design may become lowered, or it may be necessary to provide ferrite having different temperature characteristics in accordance with the structure.

SUMMARY OF THE INVENTION

In order to solve the above-described problems, an object of the present invention is to provide a small-sized laminated-type electronic component capable of obtaining a large DC superimposed allowable current value without deteriorating temperature characteristics.

The present invention provides a laminated-type electronic component includes plural magnetic material layers and plural conductive patterns; a laminated layer body formed by laminating the plural magnetic material layers and the plural conductive patterns; a coil formed in the laminated layer body by connecting the conductive patterns disposed between the magnetic material layers; and at least one magnetic gap formed in the laminated layer body, and in this laminated-type electronic component, the magnetic gaps are formed of a compound of Ni and Cu.

The laminated-type electronic component of the present invention includes plural magnetic material layers; plural conductive patterns; a laminated layer body formed by laminating the plural magnetic material layers and the plural conductive patterns; a coil formed in the laminated layer body by connecting the conductive patterns between the magnetic material layers; and at least one magnetic gap formed in the laminated layer body, and in this laminated-type electronic component, the magnetic gaps are formed of a compound of Ni and Cu; therefore, it is possible to increase a DC superimposed allowable current value without deteriorating the temperature characteristics even if the laminated-type electronic component is small-sized.

BRIEF DESCRIPTION OF THE DRAWINGS

FIG. 5 is a characteristic diagram of the third embodiment of the laminated-type electronic component of the present invention.

DETAILED DESCRIPTION OF THE INVENTION

The laminated-type electronic component of the present invention is configured such that magnetic material layers formed of ferrite containing Ni and conductive patterns made of conductors are laminated to form a laminated layer body, and the conductive patterns disposed between the magnetic material layers are spirally connected to form a coil in the laminated layer body. Magnetic gaps made of a compound of Ni and Cu containing no Zn are formed in the laminated layer body.

Hence, the laminated-type electronic component of the present invention uses no Zn in the magnetic gap, and thus no composition having the Curie point in vicinity of a room temperature is generated at interfaces between the magnetic material layers and the magnetic gaps, thereby enhancing temperature characteristics. The laminated layer body has no portion where magnetic property significantly varies depending on the temperature; accordingly a correlation between structural design of a product and properties of the product becomes preferable, thereby enhancing accuracy of the design. Embodiments Hereinafter, description will be provided on embodiments of the laminated-type electronic component of the present invention with reference to FIG. 1 to FIG. 5.

Figure 1:
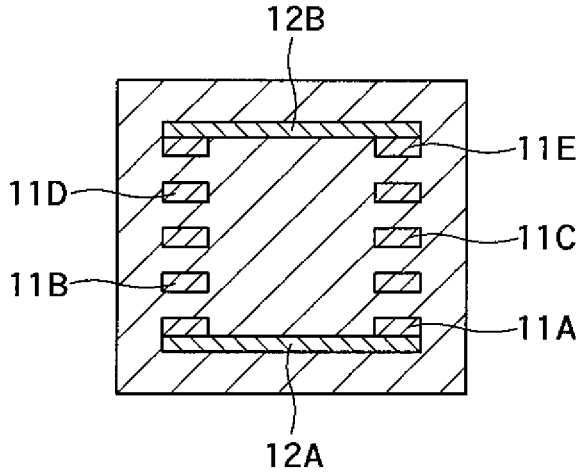
FIG. 1 is a cross sectional view showing a first embodiment of a laminated-type electronic component of the present invention.

FIG. 1 is a cross sectional view showing a first embodiment of the laminated-type electronic component of the present invention. In FIG. 1, numeral references 11A to 11E denote the conductive patterns, and numeral references 12A and 12B denotes the magnetic gaps.

Magnetic material layers are formed of Ni—Cu—Zn-based ferrite. The conductive patterns are formed of conductive paste made of a silver, silver-based, gold, gold-based or platinum metallic material in a paste form. The conductive pattern 11A is formed on a surface of a non-magnetic material layer 12A constituting the magnetic gap formed on the magnetic material layer. One end of the conductive pattern 11A extends to an end surface of the magnetic material layer. The non-magnetic material layer 12A constituting the magnetic gap is formed of a compound of Ni and Cu, and formed to be smaller in size than the magnetic material layer.

The conductive pattern 11B is formed on a surface of the magnetic material layer laminated on the conductive pattern 11A. One end of the conductive pattern 11B is connected to the other end of the conductive pattern 11A.

The conductive pattern 11C is formed on a surface of the magnetic material layer laminated on the conductive pattern 11B. One end of the conductive pattern 11C is connected to the other end of the conductive pattern 11B. The conductive pattern 11D is formed on a surface of the magnetic material layer laminated on the conductive pattern 11C. One end of the conductive pattern 11D is connected to the other end of the conductive pattern 11C.

The conductive pattern 11E is formed on a surface of the magnetic material layer laminated on the conductive pattern 11D. One end of the conductive pattern 11E is connected to the other end of the conductive pattern 11D. The other end of the conductive pattern 11E extends to an end surface of the magnetic material layer. In addition, the magnetic material layer is laminated on the conductive pattern 11E through a non-magnetic material layer 12B constituting the magnetic gap. The non-magnetic material layer 12B constituting the magnetic gap is formed of a compound of Ni and Cu, and formed to be smaller in size than the magnetic material layer. In this manner, the magnetic material layers and the conductive patterns 11A to 11E are laminated, and the conductive patterns 11A to 11E between the magnetic material layers are spirally connected to one another so as to form a coil in the laminated layer body, and the magnetic gaps are also formed in the laminated layer body. An external terminal is formed at an end surface of this laminated layer body, and the conductive pattern extending to the end surface of the laminated layer body is connected to the external terminal.

Figure 2:
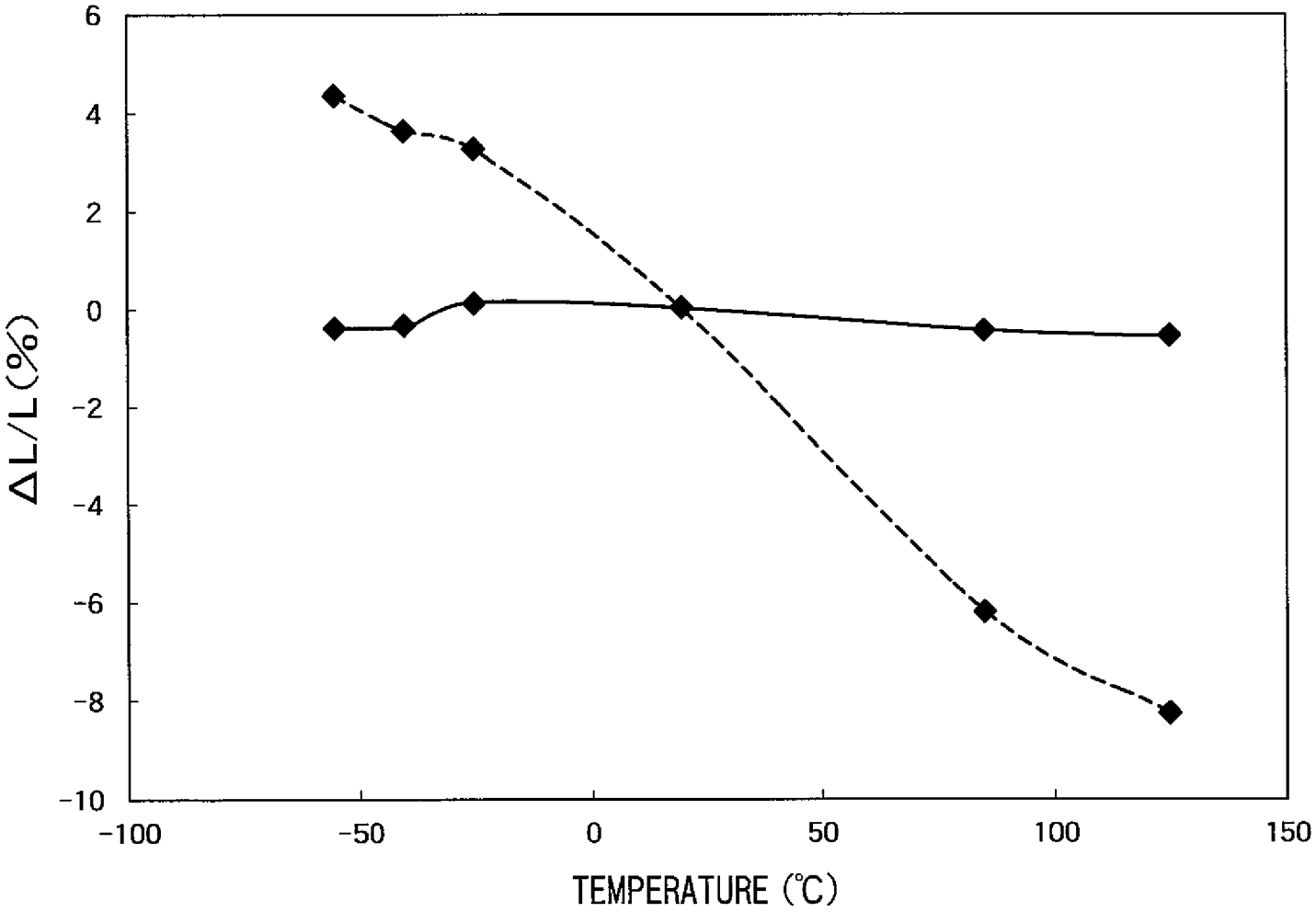
FIG. 2 is a characteristic diagram of the first embodiment of the laminated-type electronic component of the present invention.

In the laminated-type electronic component of the present invention configured in this manner, the magnetic material layers were formed of Ni—Cu—Zn-based ferrite containing NiO: 19 mol %, ZnO: 25 mol %, CuO: 9 mol %, and $Fe_2O_3$: 47 mol %, and the magnetic gaps were formed of a compound of Ni and Cu in a ratio of 8:2; and as a result of this, a rate of change of the inductance value relative to the temperature became approximately zero, as shown by a solid line of FIG. 2.

Specifically, a conventional laminated-type electronic component having magnetic material layers formed of Ni—Cu—Zn-based ferrite containing NiO: 19 mol %, ZnO: 25 mol %, CuO: 9 mol %, and $Fe_2O_3$: 47 mol %, and having the magnetic gaps formed of Cu—Zn-based ferrite had a rate of change of the inductance value relative to the temperature of 8% at maximum, as shown by a dotted line of FIG. 2; and compared to this conventional component, the electronic component of the present invention could greatly enhance the temperature characteristics.

In the laminated-type electronic component of the present invention configured in this manner, the ratio of Ni and Cu used in the magnetic gaps was variously changed; and as a result of this, an open circuit was generated in the conductive pattern in contact with the magnetic gap whose ratio of Ni was 1 or less; to the contrary, no sintering was generated in the magnetic gap whose ratio of Ni was 9 or more after burned at a temperature of 900° C.

The laminated layer body using various ratios of Ni to Cu of 2:8, 5:5, 8:2 attained magnetic permeability at 1 MHz of 118, 119, and 120, respectively. Increase in ratio of Ni contributed to increase in the magnetic permeability of the laminated layer body, thereby increasing the inductance value of the coil formed in the laminated layer body.

Figure 3:
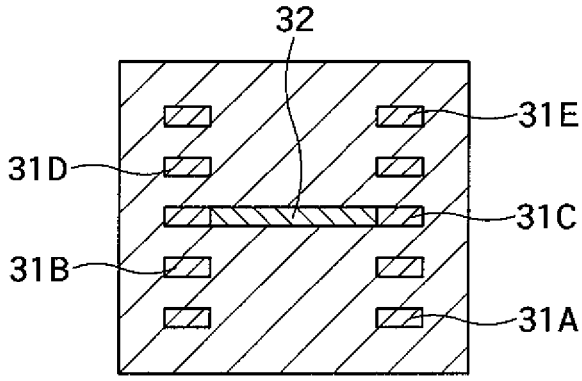
FIG. 3 is a cross sectional view showing a second embodiment of the laminated-type electronic component of the present invention.

FIG. 3 is a cross sectional view showing a second embodiment of the laminated-type electronic component of the present invention. In the second embodiment, the magnetic material layers are formed of Ni—Cu—Zn-based ferrite. The conductive patterns are formed of conductive paste made of a silver, silver-based, gold, gold-based or platinum metallic material in a paste form.

A conductive pattern 31A is formed on a surface of the magnetic material layer, and one end thereof extends to an end surface of the magnetic material layer. A conductive pattern 31B is formed on a surface of the magnetic material layer laminated on the conductive pattern 31A. One end of the conductive pattern 31B is connected to the other end of the conductive pattern 31A.

A conductive pattern 31C is formed on a surface of the magnetic material layer laminated on the conductive pattern 31B. A non-magnetic material layer 32 constituting the magnetic gap is formed in an inner circumference of the conductive pattern 31C. The non-magnetic material layer 32 constituting this magnetic gap is formed of a compound of Ni and Cu. One end of the conductive pattern 31C is connected to the other end of the conductive pattern 31B.

A conductive pattern 31D is formed on a surface of the magnetic material layer laminated on the conductive pattern 31C. One end of the conductive pattern 31D is connected to the other end of the conductive pattern 31C.

A conductive pattern 31E is formed on a surface of the magnetic material layer laminated on the conductive pattern 31D. One end of the conductive pattern 31E is connected to the other end of the conductive pattern 31D. The other end of the conductive pattern 31E extends to an end surface of the magnetic material layer.

In this manner, the magnetic material layers and the conductive patterns 31A to 31E are laminated, and the conductive patterns 31A to 31E between the magnetic material layers are spirally connected to one another so as to form a coil in the laminated layer body, and the magnetic gap is also formed in the laminated layer body. An external terminal is formed at an end surface of this laminated layer body, and the conductive pattern extending to the end surface of the laminated layer body is connected to the external terminal.

Figure 4:
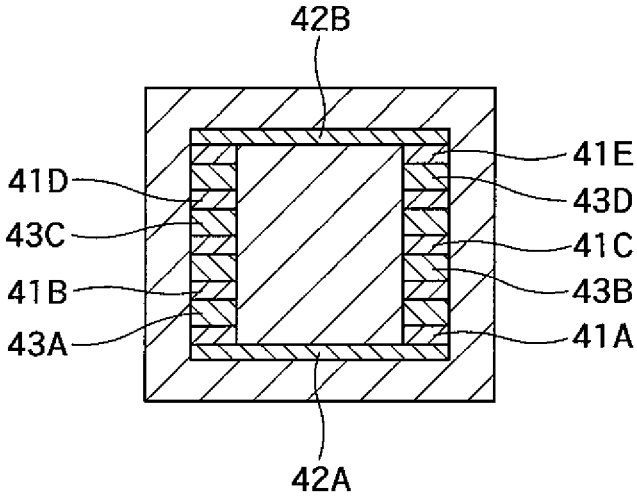
FIG. 4 is a cross sectional view showing a third embodiment of the laminated-type electronic component of the present invention.
Figure 6:
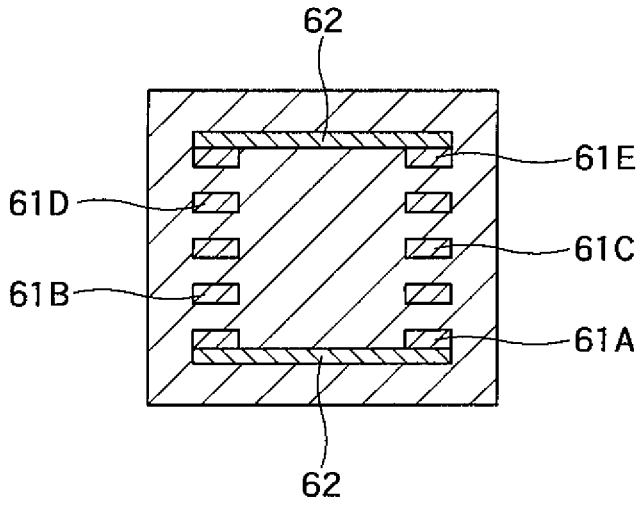
PRIOR ART FIG. 6
FIG. 6 is a cross sectional view of a conventional laminated-type electronic component.

FIG. 4 is a cross sectional view showing a third embodiment of the laminated-type electronic component of the present invention. In the third embodiment, the magnetic material layers are formed of Ni—Cu—Zn-based ferrite. The conductive patterns are formed of conductive paste made of a silver, silver-based, gold, gold-based or platinum metallic material in a paste form.

A conductive pattern 41A is formed on a surface of a non-magnetic material layer 42A constituting the magnetic gap formed on the magnetic material layer. One end of the conductive pattern 41A extends to an end surface of the magnetic material layer. The non-magnetic material layer 42A constituting the magnetic gap is formed of a compound of Ni and Cu, and formed to be smaller in size than the magnetic material layer. A conductive pattern 41B is formed on a surface of a non-magnetic material portion 43A that constitutes the magnetic gap, and vertically extends through the magnetic material layer laminated on the conductive pattern 41A. One end of the conductive pattern 41B is connected to the other end of the conductive pattern 41A.

A conductive pattern 41C is formed on a surface of a non-magnetic material portion 43B that constitutes the magnetic gap, and vertically extends through the magnetic material layer laminated on the conductive pattern 41B. One end of the conductive pattern 41C is connected to the other end of the conductive pattern 41B.

A conductive pattern 41D is formed on a surface of a non-magnetic material portion 43C that constitutes the magnetic gap, and vertically extends through the magnetic material layer laminated on the conductive pattern 41C. One end of the conductive pattern 41D is connected to the other end of the conductive pattern 41C.

A conductive pattern 41E is formed on a surface of a non-magnetic material portion 43D that constitutes the magnetic gap, and vertically extends through the magnetic material layer laminated on the conductive pattern 41D. One end of the conductive pattern 41E is connected to the other end of the conductive pattern 41D. The other end of the conductive pattern 41E extends to an end surface of the magnetic material layer. The magnetic material layer is further laminated on the conductive pattern 41E through a non-magnetic material layer 42B constituting the magnetic gap. The non-magnetic material layer 42B constituting the magnetic gap is formed of a compound of Ni and Cu, and formed to be smaller in size than the magnetic material layer. In this manner, the magnetic material layers and the conductive patterns 41A to 41E are laminated, and the conductive patterns 41A to 41E between the magnetic material layers are spirally connected to one another so as to form a coil in the laminated layer body, and the magnetic gaps are also formed in the laminated layer body. An external terminal is formed at an end surface of this laminated layer body, and the conductive pattern extending to the end surface of the laminated layer body is connected to the external terminal.

In the laminated-type electronic component of the present invention configured in this manner, the magnetic material layers were formed of Ni—Cu—Zn-based ferrite made by adding $SnO_2$ of 0.6 to 1.5 wt % to a ferrite material containing NiO: 19 to 45 mol %, ZnO: 1 to 25 mol %, CuO: 6 to 10 mol %, and $Fe_2O_3$: 47 to 49 mol %, and the magnetic gaps were formed of a compound of Ni and Cu in a ratio of 0:10 to 10:0; and as a result of this, the rate of change of the inductance value became as shown in FIG. 5. Note that each specimen No. marked with an asterisk (*) in a table of FIG. 5 represents that this specimen deviated from the scope of the present invention (Comparative Examples).

All the compositions used in the laminated-type electronic component of the present invention attained a smaller rate of change of the inductance value than that of the conventional laminated-type electronic component using Cu—Zn-based ferrite in the magnetic gaps.

In the magnetic material layers formed of Ni—Cu—Zn-based ferrite made by adding $SnO_2$ of 1.5 wt % to a ferrite material containing NiO: 19 mol %, ZnO: 25 mol %, CuO: 9 mol %, and $Fe_2O_3$: 47 mol %, the magnetic gaps whose ratio of Ni to Cu was other than 2:8 to 8:2 resulted in cracking, or an open circuit in the conductive pattern in contact with this magnetic gap.

In addition, in the magnetic material layers formed of Ni—Cu—Zn-based ferrite made by adding $SnO_2$ of 1.5 wt % to a ferrite material containing NiO: 27 mol %, ZnO: 14 mol %, CuO: 10 mol %, and $Fe_2O_3$: 49 mol %, the magnetic gap formed of a compound of Ni and Cu whose ratio of Ni to Cu was 8:2 attained a smaller rate of change of the inductance value, compared to the conventional laminated-type electronic component having the magnetic material layers formed of Ni—Cu—Zn-based ferrite containing no $SnO_2$, and having no magnetic gap. The electronic component of the present invention also attained a rate of change of the inductance value equal to that of the conventional laminated-type electronic component having magnetic material layers formed of Ni—Cu—Zn-based ferrite made by adding $SnO_2$ of 1.5 wt % to a ferrite material containing NiO: 27 mol %, ZnO: 14 mol %, CuO: 10 mol %, and $Fe_2O_3$: 49 mol %, and having no magnetic gap.

The embodiments of the laminated-type electronic component of the present invention have been described above, but the present invention is not limited to them. For example, the magnetic material layers may be formed of Ni—Zn-based ferrite or Ni ferrite. The ferrite constituting the magnetic material layers may contain slight amount of elements derived from its material such as $MnO_2$, $SiO_2$, and the like. The compound of Ni and Cu included in the magnetic gaps may contain slight amount of elements derived from its material, or may contain $SnO_2$ to prevent dispersion of $SnO_2$ contained in the ferrite constituting the magnetic material layers. In addition, the non-magnetic material layers constituting the magnetic gaps may be formed in the same size as that of the magnetic material layers. Metallic foils may be used in the conductive patterns. The non-magnetic material layers constituting the magnetic gaps may be formed in three or more layers. In the second embodiment, the non-magnetic material portions constituting the magnetic gaps may be disposed between the conductive patterns.

What is claimed is:

1. A laminated-type electronic component comprising:

plural magnetic material layers;

plural conductive patterns;

a laminated layer body formed by laminating the plural magnetic material layers and the plural conductive patterns;

a coil formed in the laminated layer body by connecting the conductive patterns between the magnetic material layers; and at least one magnetic gap formed in the laminated layer body, wherein the magnetic material layers are formed of a ferrite including Ni, and the at least one magnetic gap is formed of a compound consisting of Ni and Cu not including Zn and Fe.

2. The laminated-type electronic component according to claim 1, wherein the magnetic material layers are formed of Ni—Cu—Zn-based ferrite made by adding SnO2 of 0.6 to 1.5 wt % to a ferrite material containing NiO: 19 to 45 mol %, ZnO: 1 to 25 mol %, CuO: 6 to 10 mol %, and Fe203: 47 to 49 mol %.

3. The laminated-type electronic component according to claim 1, wherein a ratio of Ni to Cu, which forms the compound for forming the magnetic gaps, is 2:8 to 8:2.

4. The laminated-type electronic component according to claim 1, wherein plural magnetic gaps are formed in the laminated layer body.

* * * * *